US010976685B2

(12) United States Patent
Mitsui et al.

(10) Patent No.: US 10,976,685 B2
(45) Date of Patent: Apr. 13, 2021

(54) IMAGE FORMING APPARATUS TO PERFORM AN ACTIVATION CONTROL USING A DEVELOPING BIAS APPLYING MEMBER AND A SPEED CONTROL UNIT

(71) Applicant: CANON KABUSHIKI KAISHA, Tokyo (JP)

(72) Inventors: Yoshihiro Mitsui, Numazu (JP); Takuya Oka, Yokohama (JP); Yasukazu Ikami, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/168,731

(22) Filed: Oct. 23, 2018

(65) Prior Publication Data

US 2019/0121255 A1 Apr. 25, 2019

(30) Foreign Application Priority Data

Oct. 24, 2017 (JP) ..... JP2017-205572

(51) Int. Cl.

| | |
|---|---|
| ***G03G 15/00*** | (2006.01) |
| ***G03G 21/14*** | (2006.01) |
| ***G03G 15/08*** | (2006.01) |
| ***G03G 15/06*** | (2006.01) |
| *G03G 15/095* | (2006.01) |

(52) U.S. Cl.

CPC ..... *G03G 15/0812* (2013.01); *G03G 15/065* (2013.01); *G03G 15/0806* (2013.01); *G03G 15/0808* (2013.01); *G03G 15/5008* (2013.01); *G03G 21/14* (2013.01); *G03G 15/095* (2013.01)

(58) Field of Classification Search

CPC ..... G03G 15/065; G03G 15/5008; G03G 15/095; G03G 15/0813; G03G 15/0806; G03G 15/0898; G03G 15/5012

See application file for complete search history.

(56) References Cited

U.S. PATENT DOCUMENTS

| | | | | |
|---|---|---|---|---|
| 6,026,266 | A * | 2/2000 | Sakai | G03G 15/065 399/281 |
| 8,005,381 | B2 * | 8/2011 | Shimizu | G03G 15/0812 399/284 |
| 9,383,676 | B2 * | 7/2016 | Hironaka | G03G 15/5008 |
| 10,394,156 | B2 * | 8/2019 | Ozeki | G03G 15/0266 |
| 2008/0063960 | A1 | 3/2008 | Hayata et al. | |

(Continued)

FOREIGN PATENT DOCUMENTS

| | | | | |
|---|---|---|---|---|
| EP | 3096187 | A1 | 11/2016 | |
| JP | 57128354 | A * | 8/1982 | G03G 15/75 |

(Continued)

*Primary Examiner* — Arlene Heredia

(74) *Attorney, Agent, or Firm* — Canon U.S.A., Inc. IP Division

(57) ABSTRACT

An image forming apparatus in which when toner remaining on a development roller in an area from a developer nip to a regulating blade disposed upstream of a rotation direction of the development roller during a stoppage of the image forming apparatus passes through the developer nip, a bias is applied so that the toner is drawn to the development roller, and a relative speed difference between the photosensitive drum and the development roller is created so as to be larger than the that during an image forming operation.

18 Claims, 6 Drawing Sheets

(56) References Cited

U.S. PATENT DOCUMENTS

| | | | | |
|---|---|---|---|---|
| 2008/0069590 | A1 | 3/2008 | Shigehiro | |
| 2015/0098717 | A1* | 4/2015 | Park | G03G 21/0047 399/46 |

FOREIGN PATENT DOCUMENTS

| | | | |
|---|---|---|---|
| JP | H0635257 | A | 2/1994 |
| JP | 2016050953 | A | 4/2016 |

* cited by examiner

IMAGE FORMING APPARATUS TO PERFORM AN ACTIVATION CONTROL USING A DEVELOPING BIAS APPLYING MEMBER AND A SPEED CONTROL UNIT

BACKGROUND OF THE INVENTION

Field of the Invention

The present disclosure relates to image forming apparatus adopting an electrophotographic method.

Description of the Related Art

Hitherto, as an image forming apparatus that adopts an electrophotographic method, an image forming apparatus that visualizes an electrostatic latent image by using mono-component developer (hereinafter, referred to as toner) is known. Mono-component contact developing method is one of the types of method adopted in such an image forming apparatus, in which the photosensitive drum serving as an image carrying member and the developer roller serving as a developer carrying member perform developing while in contact with each other. Furthermore, as a type of such an image forming apparatus, there is an image forming apparatus having a simple configuration in which the photosensitive drum and the development roller do not have a separating mechanism (hereinafter, referred to as developing member includes no separation mechanism).

Hitherto, in an image forming apparatus adopting a mono-component contact developing method in which the developing member includes no separation mechanism, there are cases in which a large amount of toner (hereinafter, referred to as an "activation fog") is unintentionally transferred from the developing roller to the photosensitive drum during activation of the image forming apparatus.

Disclosed in Japanese Patent Laid-Open No. 6-35257 is an application of a transfer bias to the transfer roller until an uncharged area reaches the developer nip, in which the transfer bias has a reverse polarity with respect to the polarity during a normal image forming period so that the fogging toner does not become transferred to the transfer roller. The toner not being transferred to the transfer roller and remaining on the photosensitive drum transfer roller is removed by a cleaning device.

However, in the solution in Japanese Patent Laid-Open No. 6-35257, ultimately, during a pre-rotation operation from the activation to the start of image formation, the "activation fog" itself cannot be suppressed or reduced. Such leads to unnecessary consumption of toner and an increase in the amount of waste toner, and becomes an obstacle in saving energy, reducing the size, and elongating the life of the image forming apparatus.

In particular, the amount of charge of the toner in the "activation fog" that is generated by a decrease in the amount of charge of the toner on the developing roller during the stoppage period of the image forming apparatus is lower than the amount of charge of the toner in the fog generated during continuous operation of the image forming apparatus. Accordingly, the toner consumption amount per operation is extremely large when compared with the toner consumption amount of the fog during the image-forming period.

In a case in which there is a mechanism that abuts and separates the development roller and the photosensitive drums from each other during the stoppage, the activation fog described above can be prevented by separating the development roller from the photosensitive drum. However, it is important to solve the above problem in an image forming apparatus that does not have any abutting and separating mechanism.

SUMMARY OF THE INVENTION

An image forming apparatus according to the present disclosure includes an image carrying member capable of forming an electrostatic latent image, a developer carrying member adapted to develop the electrostatic latent image with developer, a charge roller that adapted to charge a surface of the image carrying member, a regulating blade adapted to regulate the developer on the developer carrying member, a speed control unit adapted to control a circumferential velocity of the developer carrying member in an independent manner with respect to a circumferential velocity of the image carrying member, and a developing bias applying member adapted to apply a bias to the developer carrying member, the developer carrier member including an area A situated from a developer nip between the image carrying member and the developer carrying member to the regulating blade disposed upstream of the developer nip in a rotation direction of the developer carrying member. In the image forming apparatus, the developing bias applying member is adapted to create an electric potential relationship between the image carrying member and the developer carrying member so that the developer is drawn to the developer carrying member when the developer carried in area A on the developer carrying member during a stoppage of the image forming apparatus passes the developer nip with a rotation of the developer carrying member, and, the speed control unit is adapted to control a relative speed difference between the developer carrying member and the image carrying member, after activation from a stopped state, to be larger than that during an image forming operation until the area A on the developer carrying member passes at least the developer nip for a first time.

A method of forming an image, performed by an image forming apparatus including an image carrying member capable of forming an electrostatic latent image; a developer carrying member that develops the electrostatic latent image with developer, a charge roller that charges a surface of the image carrying member, a regulating blade that regulates the developer on the developer carrying member, a speed control unit that controls a circumferential velocity of the developer carrying member in an independent manner with respect to a circumferential velocity of the image carrying member, and a developing bias applying member that applies a bias to the developer carrying member, the developer carrier member including an area A situated from a developer nip between the image carrying member and the developer carrying member to the regulating blade disposed upstream of the developer nip in a rotation direction of the developer carrying member, the method including, the developing bias applying member creating an electric potential relationship between the image carrying member and the developer carrying member so that the developer is drawn to the developer carrying member when the developer carried in area A on the developer carrying member during a stoppage of the image forming apparatus passes the developer nip with a rotation of the developer carrying member, and, the speed control unit controlling a relative speed difference between the developer carrying member and the image carrying member, after activation from a stopped state, to be larger than that during an image forming operation until the area A on the developer carrying member passes at least the developer nip for a first time.

Further features of the present invention will become apparent from the following description of exemplary embodiments with reference to the attached drawings.

DESCRIPTION OF THE EMBODIMENTS

Figure 1:
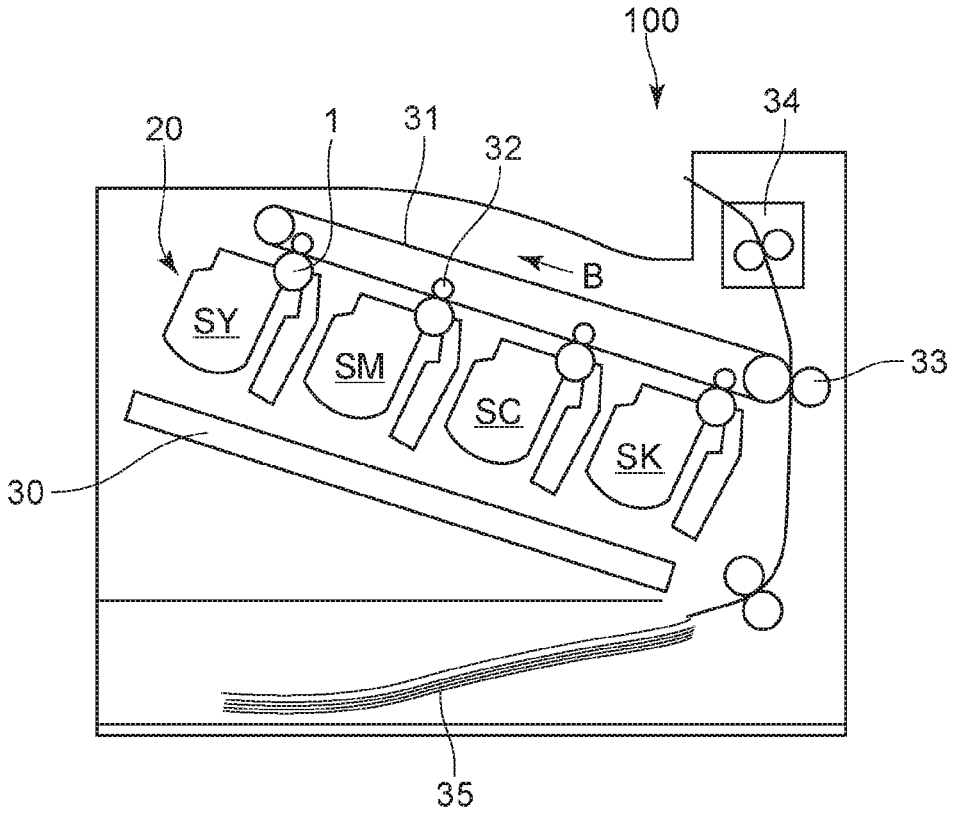
FIG. 1 is an overall schematic view of an image forming apparatus according to a first example embodiment that is a subject of the disclosure.

Hereinafter, referring to the drawings, modes for carrying out the disclosure will be exemplified in detail. Note that unless explicitly stated, the sizes, the materials, the shapes, and the relative positions of the components described in the exemplary embodiments do not limit the scope of the disclosure.

First Example Embodiment

Image Forming Apparatus

An overall configuration of an electrophotographic image forming apparatus (hereinafter, referred to as an image forming apparatus) will be described. FIG. 1 is a cross-sectional view of an image forming apparatus 100 of the present example embodiment. The image forming apparatus 100 of the present example embodiment is a full-color laser beam printer employing an intermediate transfer system and an in-line system. The image forming apparatus 100 is capable of forming a full color image on a recording material (a recording sheet, a plastic sheet, or fabric, for example) according to image information. The image information is input from an image reading device connected to an image forming apparatus main body, or from a host device, such as a personal computer, connected to the image forming apparatus main body in a transmittable manner.

The image forming apparatus 100 includes process cartridges 20 serving as a plurality of image forming units SY, SM, SC, and SK that forms images of various colors, namely, yellow (Y), magenta (M), cyan (C), and black (K), respectively. In the present example embodiment, the image forming units SY, SM, SC, and SK are disposed in a line extending in a direction intersecting the vertical direction.

The process cartridges 20 are each detachably attachable to the image forming apparatus 100 through a mount member, such as a mount guide and a positioning member, provided in the image forming apparatus main body. In the present example embodiment, the process cartridges 20 of various colors all have the same shape, and toners of various colors, namely, yellow (Y), magenta (M), cyan (C), black (K) are contained in the process cartridges 20 of various colors.

A scanner unit (an exposure device) 30 is disposed in an area around photosensitive drums 1. The scanner unit is an exposure member that projects laser beams on the photosensitive drums 1 based on image information to form electrostatic images (electrostatic latent images) on the photosensitive drums 1. The photosensitive drums 1 can each form an electrostatic latent image. In a main scanning direction (a direction orthogonal to a conveyance direction of a sheet member), laser exposure or writing in each scanning line is performed based on a signal indicating the position inside a polygon scanner called a BD. Meanwhile, in a sub scanning direction (the conveyance direction of the sheet member), the laser exposure or writing is performed after a delay of a predetermined time from when a TOP signal has been issued from a switch (not shown) situated in a sheet member conveyance path. With the above, laser exposure can be performed at same positions on the photosensitive drums 1 at all times in the four process stations Y, M, C, and Bk.

An intermediate transfer belt 31 serving as an intermediate transfer member that transfers toner images on the photosensitive drums 1 to a recording material 35 is disposed opposing the four photosensitive drums 1. The intermediate transfer belt 31 formed of an endless belt and serving as the intermediate transfer member abuts against all of the photosensitive drums 1 and circulates and moves (rotates) in an arrow B direction (counterclockwise) in the drawing. Four primary transfer rollers 32 serving as primary transfer members are arranged side by side on an inner peripheral surface side of the intermediate transfer belt 31 so as to oppose the photosensitive drums 1. Furthermore, a bias that has a polarity opposite to a normal charge polarity of the toner is applied to the primary transfer rollers 32 from a primary transfer bias power source (a high-voltage power source, not shown) serving as a primary transfer bias applying member. With the above, the toner images on the photosensitive drums 1 are transferred (primarily transferred) onto the intermediate transfer belt 31.

Furthermore, a secondary transfer roller 33 serving as a secondary transfer member is disposed on an outer peripheral surface side of the intermediate transfer belt 31. Furthermore, a bias that has a polarity opposite to the normal charge polarity of the toner is applied to the secondary transfer roller 33 from a secondary transfer bias power source (a high-voltage power source, not shown) serving as a secondary transfer bias applying member. With the above, the toner images on the intermediate transfer belt 31 are transferred (secondarily transferred) onto the recording material 35. For example, when a full color image is formed, primary transfer is performed by sequentially performing the process described above in the image forming units SY, SM, SC, and SK so that the toner images of various colors are sequentially overlaid on the intermediate transfer belt 31. Subsequently, synchronizing with the movement of the intermediate transfer belt 31, the recording material 35 is conveyed to a secondary transfer unit. Furthermore, the toner images of four colors on the intermediate transfer belt 31 are secondarily transferred onto the recording material 35 in a collective manner with the work of the secondary transfer roller 33 abutting against the intermediate transfer belt 31 with the recording material 35 interposed therebetween.

The recording material 35 on which the toner images have been transferred is conveyed to a fixing device 34 serving as a fixing member. The toner images are fixed to the recording material 35 by having heat and pressure applied to the recording material 35 in the fixing device 34.

Operation and Configuration of Process Cartridge

Figure 2:
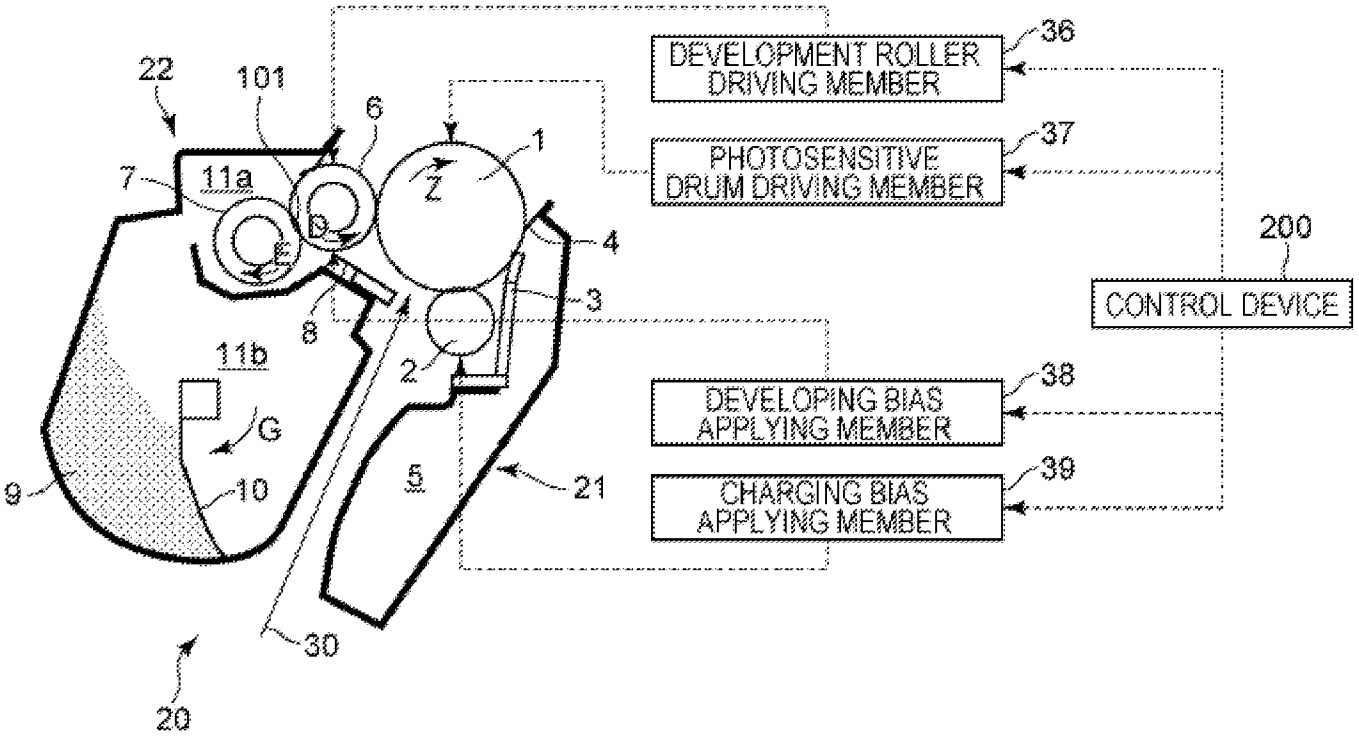
FIG. 2 is a schematic view of a process cartridge, a bias applying system, and a drive system according to the first example embodiment that is a subject of the disclosure.

An overall configuration of the process cartridge 20 mounted in the image forming apparatus of the first example embodiment will be described. FIG. 2 is a cross-sectional view (a main section) of the process cartridge 20 viewed in a longitudinal direction (in a direction of the axis of rotation) of the photosensitive drum 1. Note that in the present example embodiment, other than the types (colors) of the contained developer, the configurations and the operations of the process cartridges 20 of various colors are practically the same. The process cartridge 20 of the present example embodiment is an integration of a photosensitive member unit 21 including the photosensitive drum 1 and other members, and a developing unit (a developing device) 22 including a development roller 6 and other members. The developing unit 22 and the photosensitive member unit 21 may each be configured to be detachably attachable to the image forming apparatus main body.

The photosensitive drum 1 is rotatably attached to the photosensitive member unit 21 with bearings (not shown) in between. Furthermore, the photosensitive member unit 21 includes a charge roller 2, a cleaning member 3, and a collecting sheet member 4 that are in contact with a peripheral surface of the photosensitive drum 1, and a toner container 5. A bias sufficient enough to apply an optional electric charge on the photosensitive drum 1 is applied to the charge roller 2 from a charging bias power source (a high-voltage power source) serving as a charging bias applying member. A laser beam 30 is projected from the scanner unit (not shown) onto the photosensitive drum on the basis of image information to form an electrostatic image (an electrostatic latent image) on the photosensitive drum 1. The cleaning member 3 scrapes off the toner, which had not been transferred from the photosensitive drum 1 to the intermediate transfer belt 31, from the photosensitive drum 1 by mechanical frictional sliding force, and sends the toner that has been scraped off to the toner container 5 surrounded by the collecting sheet member 4 and the cleaning member 3.

The developing unit 22 is formed of a developing chamber 11*a* and a developer containing chamber 11*b*, and the developer containing chamber 11*b* is disposed below the developing chamber 11*a*. Toner 9 serving as developer is contained inside the developer containing chamber 11*b*. In the present example embodiment, the normal charge polarity of the toner 9 is negative. Hereinafter, a case in which negatively charged toner is used will be described. Furthermore, a toner conveying member 10 that conveys the toner 9 to the developing chamber 11*a* is provided in the developer containing chamber 11*b*. The toner conveying member 10 conveys the toner towards the developing chamber 11*a* by rotating in an arrow G direction in the drawing.

The development roller 6 serving as a developer carrying member that is in contact with the photosensitive drum 1 and that is rotated by receiving driving force from the development roller driving member is provided in the developing chamber 11*a*. The development rollers 6 pressed against the photosensitive drum 1 by a pressure applying member (not shown), such as a spring provided between the photosensitive member unit 21 and the developing unit 22, rotates while being in contact with the photosensitive drum 1. The pressure applying member may be one that applies a pressure of 0.3 to 1.5 kgf (2.9 to 14.7 N). The pressure of the pressure applying member in the present example embodiment is 1.0 kgf (9.8 N). The image forming apparatus in FIG. 1 is not provided with mechanisms that abut or separate the photosensitive drums 1 against or from the development rollers 6, and the contact state is maintained while the image forming apparatus is stopped, during the image forming operation, and when not performing the image forming operation.

During the image forming operation, the development roller 6 rotates in an arrow D direction in the drawing and a circumferential surface speed ratio against the photosensitive drum 1 is 120%. Furthermore, a toner supplying roller (hereinafter, referred to as a "supply roller") 7 that supplies the toner conveyed from the developer containing chamber 11*b* to the development roller 6 is disposed inside the developing chamber 11*a*. Furthermore, a toner-amount-regulating member (hereinafter, referred to as a "regulating blade") 8 that regulates the coating amount of toner on the development roller 6 (the developer carrying member) supplied with the supply roller 7 and that applies an electric charge is disposed in the developing chamber 11*a*. The supply roller 7 and the regulating blade 8 are disposed so as to be in contact with the development roller 6. Furthermore, the supply roller 7 and the regulating blade 8 are disposed upstream of a developer nip 101 in a rotation direction of the development roller 6. The toner that has been supplied to the development roller 6 by the supply roller 7 enters a contact and abutment portion (also referred to as a regulating nip) between the regulating blade 8 and the development roller 6 with the rotation of the development roller 6 in the arrow D direction. The toner that has entered the contact and abutment portion is triboelectrically charged due to the sliding and rubbing between the surface of the development roller 6 and the regulating blade 8, and an electric charge is applied thereto. At the same time, the layer thickness of the toner is regulated. The toner, in which the layer thickness has been regulated, on the development roller 6 is conveyed to a portion opposite the photosensitive drum 1 with the rotation of the development roller 6 and the electrostatic latent image on the photosensitive drum 1 is developed and made visible as a toner image.

A configuration of the process cartridge will be described next. The photosensitive drum 1 is formed by layering an organic photosensitive member, in which a positive-charge blocking layer, a charge generating layer, and an electric charge transfer layer are sequentially overlaid and applied, on an aluminum (AL) cylinder that is a conductive substrate having a diameter of 24 mm. Arylate is used in the electric charge transfer layer of the photosensitive drum 1, and the film thickness of the electric charge transfer layer is about 15 μm. The electric charge transfer layer is formed by melting an electric charge transfer material and a binding agent in a solvent.

The charge roller 2 is formed by providing a semi conductive rubber layer on a metal core that is a conductive support member. The charge roller exhibits a resistance of about 10^5Ω when a voltage of 200 V is applied to the conductive photosensitive drum 1.

The diameter of the development roller 6 is 15 mm. As a base layer, a silicone rubber is provided on a conductive metal core having a diameter of 6 mm, and a urethane rubber is provided as a surface layer. The development roller 6 exhibits a volume resistivity of about 10^6Ω when a voltage of 200 V is applied to the conductive photosensitive drum 1. The hardness (average hardness) of the development roller 6 is measured with ASKER Durometer Type C (manufactured by KOBUNSHI KEIKI CO., LTD.). In the present example embodiment, when measured with the ASKER Durometer Type C, the development roller 6 having an average hardness of 30 degrees to 80 degrees can be used. When smaller than 30 degrees, it will be difficult to use the development roller 6 as a development roller due to the permanent deformation caused by compression set. When larger than 80 degrees, the state of contact between the development roller 6 and the photosensitive drum 1 readily becomes unstable. In the present example embodiment, the development roller 6 having an average hardness of 55 degrees when measured with the ASKER Durometer Type C is used.

The diameter of the supply roller 7 is 15 mm. The supply roller 7 is a conducive and elastic sponge roller in which a foam layer is formed on an outer periphery of a conductive metal core having a diameter of 6 mm. The resistance value of the supply roller 7 is between 10^6Ω and 10^7Ω when a voltage of 200 V is applied to the conductive photosensitive drum 1.

Furthermore, an inroad amount of the supply roller 7 with respect to the development roller 6 is 1.0 mm. The supply roller 7 rotates in an arrow E-direction in the drawing with respect to the development roller 6, and the circumferential surface speed ratio against the development roller 6 is 150%.

The regulating blade 8 is an SUS sheet metal that is 0.1 mm thick, and is disposed so that a free edge thereof is in contact with the upstream side of the development roller 6 in the rotation direction of the development roller. The regulating blade 8 used in the present example embodiment is a regulating blade in which cutting is performed on a distal end of an SUS sheet metal from a D roller abutment surface side.

The toner 9 is negatively charged toner in which non-magnetic one-component developer to which silica microparticles serving as an external additive are externally added to the circumference thereof. In the present example embodiment, used is non-external addition toner having a mean diameter, or D50, of 7 μm that is fabricated by a suspension polymerization method and to which silica microparticles are externally added at an external addition rate (parts by weight of the external additive) of 1.5 wt % when the weight of the resin toner particles is assumed as 100 wt %. Toner having a mean diameter, or D50, of 5 to 9 μm can be used. Furthermore, the external additive having a particle diameter of 10 to 300 nm can be used.

Other than the silica microparticles, fine particles such as titanium oxide, alumina, zinc oxide, cerium oxide, tin oxide, or strontium titanate can be used as the external additive. Furthermore, as for the toner, toner in which the cohesion degree in the initial state (under a state in which the developing unit 22 has not been used) is 5% to 60% can be used.

Bias Applying Mode, Potential Settings, and Drive Speed Settings During Image Formation Bias applying mode, a bias applying mode, potential settings, drive speed settings during image formation of the present example embodiment will be described next. As illustrated in FIG. 2, the bias applying members 39 and 38 apply the required biases needed to form an image to the charge roller 2 and the development roller 6. Furthermore, bias applying members (not shown) apply biases needed in forming an image to the supply roller 7 and the regulating blade 8.

A bias is applied to the charge roller 2 during image formation so that the potential (hereinafter, referred to as Vd) on the photosensitive drum 1 (a surface of an image carrying member) is −500 V, and an adjustment is made so that the potential (hereinafter, referred to as V1) on the photosensitive drums 1 after exposure of the laser beam is −100 V. In the above, reversal developing is performed by applying a voltage of −300 V to the development roller 6 so that toner having a negative charge polarity is transferred to a V1 area. A voltage of −400 V is applied to the supply roller 7 and −450 is applied to the regulating blade 8.

Drive speed and setting of the drive speed during image formation according to the present example embodiment will be described next. With driving members 36 and 37 illustrated in FIG. 2, the circumferential surface speed of the photosensitive drum 1 is set to 210 mm/sec, and the circumferential surface speed ratio of the development roller 6 with respect to the photosensitive drum 1 is set to 120% and the circumferential surface speed of the development roller 6 is set to 252 mm/sec.

A control device 200 in FIG. 2 includes a central processing unit (CPU) provided in the image forming apparatus main body and storage units including a random access memory (RAM), a read only memory (ROM), and the like. The control device 200 further includes an input output circuit. The control device 200 is configured so as to be capable of controlling the operations and timings of the development roller driving member 36, the photosensitive drum driving member 37, the developing bias applying member 38, and the charging bias applying member 39.

Bias Applying Mode and Drive Control Mode During Activation of Image Forming Apparatus A bias applying mode, a drive control mode, a bias applying timing, and a drive timing during activation of the image forming apparatus, which are features of the present example embodiment will be described next.

Activation Fog

Figure 6A:
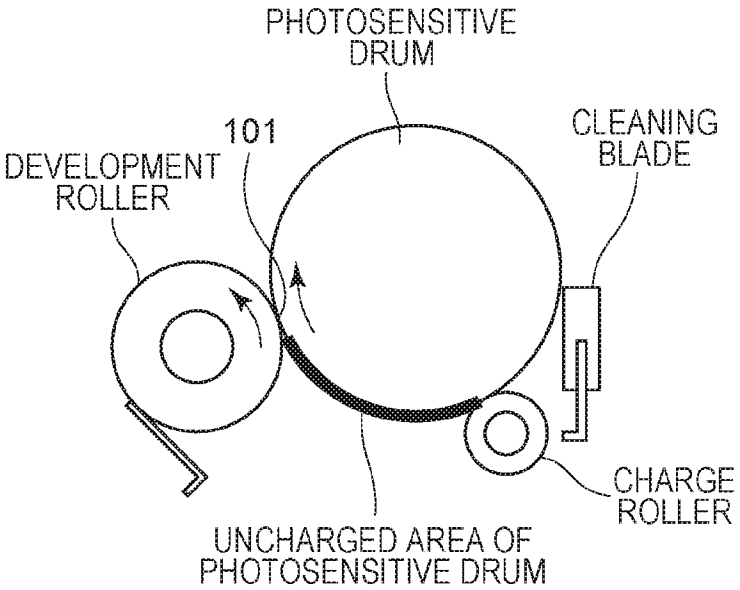
FIGS. 6A and 6B are schematic diagrams illustrating a cause of the generation of the "activation fog".
Figure 6B:
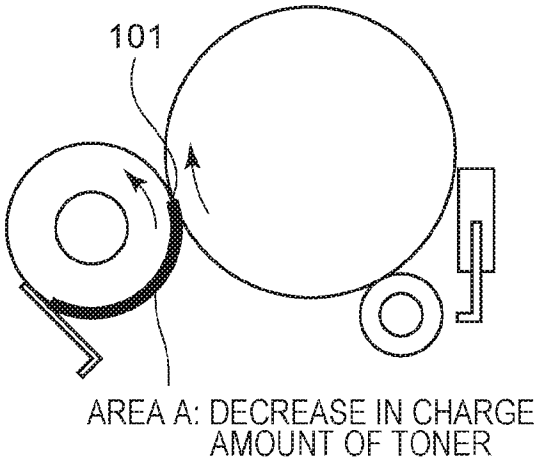

Causes of an "activation fog" will be described with reference to FIGS. 6A and 6B. As illustrated in FIG. 6A, the activation fog is, firstly, caused by an uncharged area of the photosensitive drum entering the developer nip 101. Secondly, the activation fog is caused by a decrease in a charge amount of the toner on the development roller (the developer carrying member) while the image forming apparatus has been stopped. In particular, during the activation, since an area A illustrated in FIG. 6B is not slid or rubbed by the member until passing through the developer nip 101, the charge amount thereof becomes significantly low. Accordingly, electrical control in the developer nip 101 becomes difficult and the amount of fog becomes large.

Bias Applying Mode

An object of the present example embodiment is to suppress generation of the "activation fog" on the photosensitive drum 1 during activation caused by the toner in area A (FIG. 6A) during stoppage of the image forming apparatus. Accordingly, an electric potential relationship is established so that the toner that is charged to a normal polarity and that is on the development roller 6 is biased towards the development roller 6 side. Furthermore, based on the command of the control device 200, the developing bias applying member 38 in FIG. 2 applies a bias, which has a polarity that is opposite to the normal charge polarity of the toner, to the development roller 6. Note that in the present example embodiment, the normal polarity is a negative polarity; however, it is apparent to a person skilled in the art that even in a case in which the normal polarity is a positive polarity, a bias having an opposite polarity can be applied by inverting the polarity of the applied bias.

Drive Control Mode

Furthermore, the control device 200 performs control so that a relative speed difference between the photosensitive drum 1 and the development roller 6 is larger than that during the image forming operation at least during the period between the activation of the image forming apparatus and when the area A on the development roller 6 illustrated in FIG. 6B passes the developer nip portion 101.

Accordingly, in the present example embodiment, field oriented control (FOC) motors serving as the driving members 36 and 37 are provided to the photosensitive drum 1 and the development roller 6, respectively. Since the appearance of an IC on which a vector control algorithm is implemented, cost reduction of FOC motors has become possible. The FOC motor is characterized in that compared with motors that have been used in conventional electrophotographic image forming apparatuses, the rotation stability in the low speed range is excellent and a change in the rotation speed during the drive can be executed with high accuracy. In the present example embodiment, the control device 200 controls the drive speeds and the drive timings of the driving members 36 and 37 described above. In other words, the control device 200 operates as a speed control unit.

Timing Chart

Figure 3:
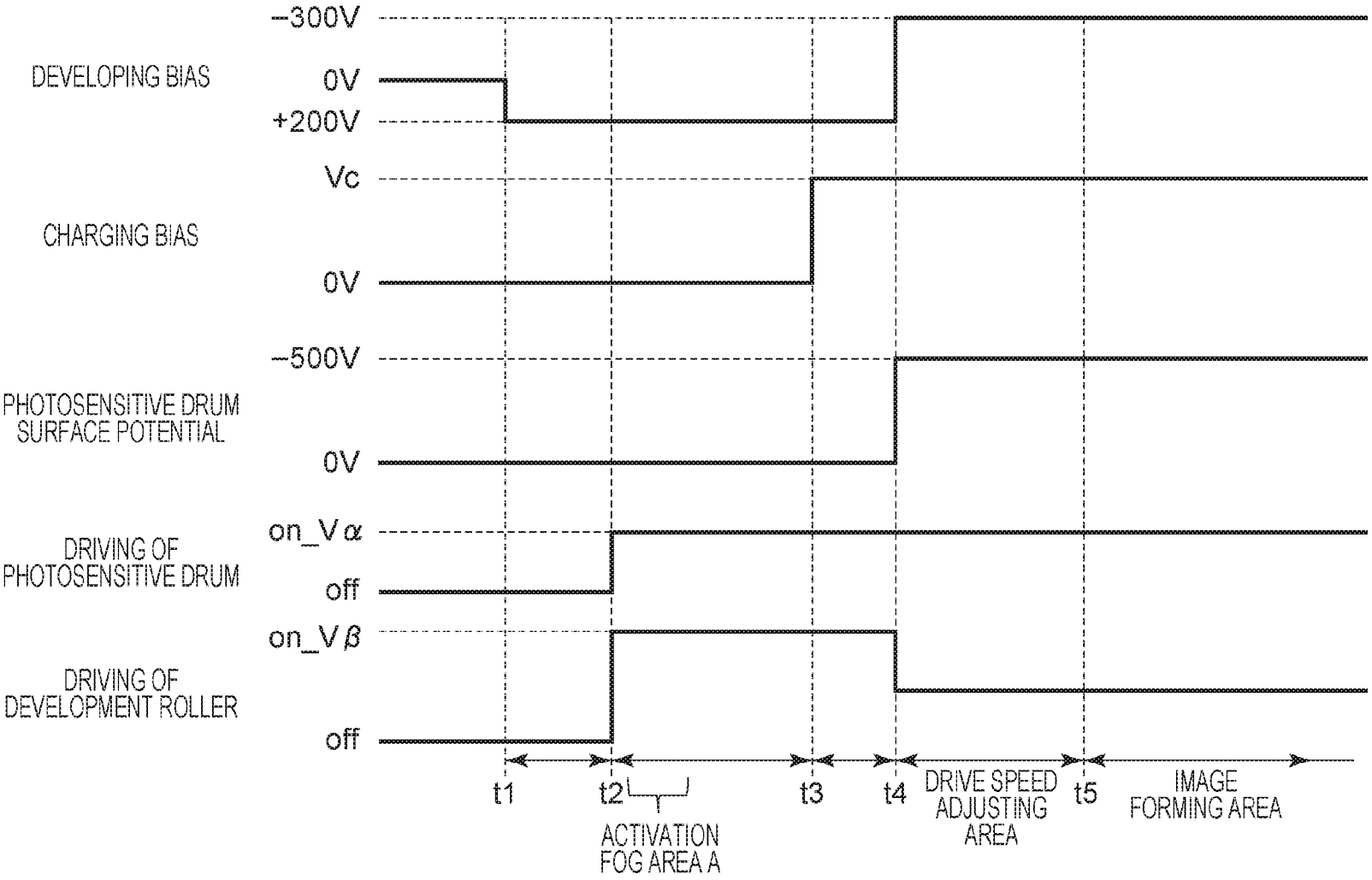
FIG. 3 is a timing chart depicting a bias applying timing and a drive control timing according to the first example embodiment that is a subject of the disclosure.

An outline of a timing chart of the bias application control and the drive control used in the effect confirmation experiment described later in the present example embodiment is illustrated in FIG. 3.

At time t1, first, in a state in which the drive of the photosensitive drum 1 and the drive of the development roller are stopped, the developing bias applying member 38 applies a development bias of +200 V having an inverted polarity with respect to the normal charge polarity of the toner. With the above, during the stoppage of the development roller 6, and in the developer nip 101 during driving, the toner on the development roller 6 can be drawn to the development roller as much as possible.

Subsequently, the photosensitive drum driving member 37 that drives the photosensitive drum 1 and the development roller driving member 36 that drives the development roller 6 that are in a stopped state are activated at time t2, and the photosensitive drum 1 and the development roller 6 are driven at predetermined rotation speeds (circumferential velocities) of Vα and Vβ, respectively. The difference between Vα and Vβ corresponds to "Relative Speed Difference: Photosensitive Drum—Developing Roller" described later. The relative speed difference during an activation fog prevention sequence is set larger than that during an ordinary image-forming period, which is a feature of the present exemplary embodiment.

All or a portion of a section between time t2 and time t3 in which the area A of the development roller 6 is included is the range in which the issue, "activation fog", is generated. Note that in actuality, time to adjust the drive speeds of the units, such as, for example, stabilizing the rotation speed of the polygon that performs laser scanning is needed until the development roller 6 transfers the toner image carried on the photosensitive drum 1 to the recording material. Furthermore, a predetermined time is needed for the recording material 35 to be conveyed to the transfer portion. Accordingly, from the viewpoint of forming an image, there is no problem in setting the development bias to a polarity that is opposite to the normal charge polarity and turning the charging bias off in the section between time t and time t3.

Subsequently, at time t3, a charging bias is applied, and the surface of the photosensitive drum 1 is charged to −500 V that is a voltage during image formation. Subsequently, synchronizing with the timing (t4) at which the position on the photosensitive drum 1 charged to −500V reaches the developer nip 101, the developing bias applying member 38 switches the development bias to −300 V that is a bias during image formation. By setting the relative speed described above to be larger than that during the ordinary image forming operation at least until the surface of the photosensitive drum 1 charged to a predetermined potential (−500 V in the present example embodiment), which is a potential during the image-forming period, reaches the developer nip 101, activation fog can be reduced effectively.

Subsequently, the drive speeds of the motors are switched between time t4 and time t5, and control is performed so that the speeds after the switching becomes stabilized so that by time t5, which is when the image forming operation starts, the drive speeds of the photosensitive drum 1 and the development roller 6 are adjusted to those during the image-forming period. Subsequently, after time t5, the image forming operation is carried out.

Note that in the timing chart in FIG. 3, the rotation speed difference between Vα and Vβ are set larger than that during the ordinary image-forming period even after the timing corresponding to area A. However, it has been confirmed that a satisfactory result can be obtained if the time when the relative speed difference described above is, with the development roller driving member 36 and/or the photosensitive drum driving member 37, set larger than that during the ordinary image forming operation is continued at least during the timing corresponding to area A and, furthermore, during the photosensitive drum uncharged area is passing through the developer nip 101. Furthermore, it has been confirmed that in a case in which the time period in which the photosensitive drum uncharged area passes through the developer nip 101 is longer than the time period corresponding to area A, a satisfactory result can be obtained by setting the time in which the photosensitive drum uncharged area passes through the developer nip 101 as the time in which the relative speed difference described above is set larger than that during the ordinary image forming operation.

Details of controlling the exemplary embodiment of the present example embodiment will be described. Note that the values of the drive speed and the relative speed difference described below are values calculated using the mean speed in the section between time t2 and time t3 in FIG. 3 including the area A in FIG. 6B.

Comparative Example 1

In comparative example 1, the drive speeds of the photosensitive drum 1 and the development roller 6 during the time between time t2 and time t3 in FIG. 3 were the same as those during the image-forming period, and the relative speed difference between the photosensitive drum 1 and the development roller 6 was 42 mm/sec.

Example 1

In example 1, the circumferential speed ratio of the development roller 6 against the photosensitive drum 1 during the time between time t2 and time t3 in FIG. 3 was set to 240%. The relative speed difference between the development roller 6 and the photosensitive drum 1 was 294 mm/sec.

Example 2

In example 2, the circumferential speed ratio of the development roller 6 against the photosensitive drum 1 during the time between time t2 and time t3 in FIG. 3 was set to 60%. The relative speed difference between the development roller 6 and the photosensitive drum 1 was 84 mm/sec.

Example 3

In example 3, during the time between time t2 and time t3 in FIG. 3, the photosensitive drum circumferential surface speed was set to 42 mm/sec and the circumferential speed ratio of the development roller 6 against the photosensitive drum 1 was set to 300%. The relative speed difference between the development roller 6 and the photosensitive drum 1 was 84 mm/sec.

Experiment Results Verifying Effect of Disclosure

Results of an experiment for verifying the effect of the disclosure will be described. The experiment was conducted under an environment of 23° C. in temperature and 50% in humidity, and the image forming apparatus activation control illustrated in FIG. 3 was performed after stopping the apparatus for 24 hours after an image forming operation and in a state in which the intermediate transfer belt 31 was separated from the photosensitive drum 1. After the above, near time t4, the image forming operation was stopped and the amount of toner collected in the toner container was measured. By so doing, the effect obtained by changing the control in the activation fog area between time t2 and time t3 was verified with accuracy.

Note that in the present experiment, the above operation was performed three times, and the amount of toner collected in the toner container per operation was compared and verified amongst comparative example 1 and examples 1 to 3. The results are shown in Table 1.

TABLE 1

Table 1: Experiment Results Showing Effects of Disclosure in First Example Embodiment

| | Comparative Example 1 | Example 1 | Example 2 | Example 3 |
|---|---|---|---|---|
| Circumferential Surface Speed (mm/sec) of Photosensitive Drum | 210 | 210 | 210 | 42 |
| Circumferential Speed Ratio (%) between Developing Roller and Photosensitive Drum | 120% | 240% | 60% | 300% |
| Circumferential Surface Speed (mm/sec) of Developing Roller | 252 | 504 | 126 | 126 |
| Relative Speed Difference (mm/sec): Developing Roller − Photosensitive Drum | 42 | 294 | −84 | 84 |
| Collected Amount (mg) per Operation | 4.0 | 2.0 | 2.1 | 2.2 |
| Rotational Distance Ratio (%) between Development Roller and Comparative Example 1 | 100% | 200% | 50% | 50% |
| Rotational Distance Ratio (%) between Photosensitive Drum and Comparative Example 1 | 100% | 100% | 100% | 20% |

As shown in Table 1, example 1 resulted in a decrease in the amount of toner collected per operation compared with comparative example 1, that is, the amount decreased from 4.0 mg to 2.0 mg. Furthermore, examples 2 and 3 were similar to example 1, in which in example 2, the collected amount decreased from 4.0 mg to 2.1 mg, and in example 3, the collected amount decreased from 4.0 mg to 2.2 mg.

Furthermore, in addition to an effect of suppressing the "activation fog", example 2 had an effect of elongating the life of the developing unit 22 since the rotational distance of the development roller was reduced to 50% with respect to that of the comparative example 1. Moreover, in addition to an effect of suppressing the "activation fog", example 3 had an excellent effect of elongating the lives of the developing unit 22 and the photosensitive member unit 21 since the rotational distance of the photosensitive drum 1 was further reduced to 20% with respect to that of the comparative example 1.

The reason that the effects in Table 1 were obtained is as follows. As described above, the cause of the area A having a lot of "activation fog" is, while the image forming apparatus is stopped, the noticeable reduction in the amount of charge of the toner that has been carried to area A by the development roller when the operation of the image forming apparatus has been completed. Even if the development bias having an opposite polarity is applied to the toner when the toner, in area A, having a reduced amount of charge reaches the development position, it will be difficult to electrically control the toner; accordingly, it will be difficult to reduce the "activation fog".

Figure 4B:
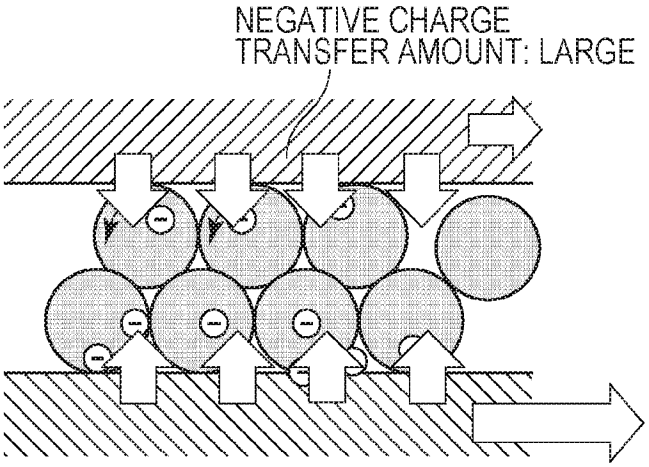
FIGS. 4A and 4B are schematic diagrams illustrating a toner triboelectric charging process in a developer nip of example 1 that is a subject of the disclosure.
Figure 4A:
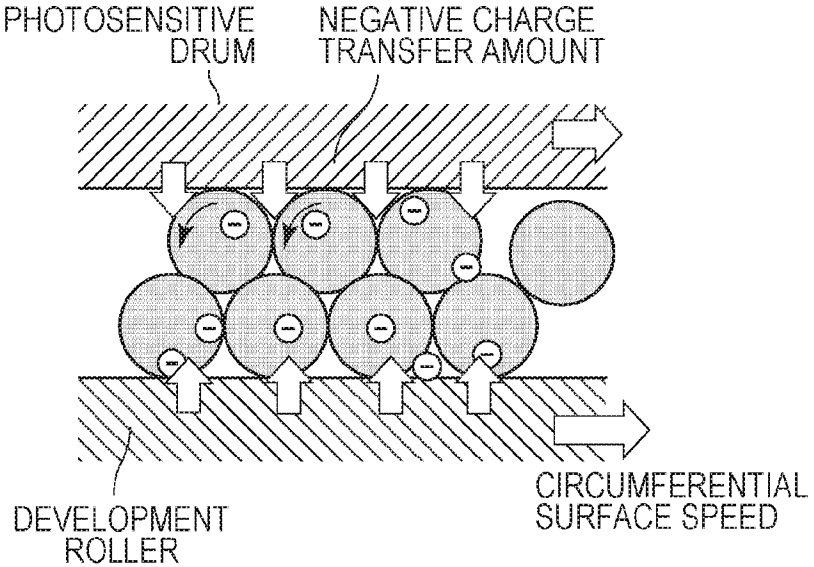

The inventors have focused on the triboelectric charging process of the toner at the developer nip 101 as a method to increase the amount of charge of the toner on the development roller in area A. FIGS. 4A and 4B illustrate schematic diagrams of the triboelectric charging process in the developer nip 101. The toner rolls in the developer nip 101, and is triboelectrically charged with the photosensitive drum 1 and with the development roller 6. In comparative example 1, the relative speed difference between the development roller 6 and the photosensitive drum 1 is 42 mm/sec and the amount of rolling of the toner in the developer nip 101 is relatively small and, consequently, the triboelectric charging amount is relatively small. On the other hand, in example 1, the relative speed difference between the development roller 6 and the photosensitive drum 1 is 294 mm/sec and the amount of rolling of the toner is large and, consequently, triboelectric charging becomes active; accordingly, the amount of negative electric charge from the photosensitive drum 1 and the development roller 6 becomes relatively large. With the above, the amount of charge of the toner in area A that has been decreased while the image forming apparatus had been stopped can be increased when passing through the developer nip 101.

Subsequently, the toner in area A in which the amount of the negative charge has been increased in example 1 is drawn to the development roller 6 with the development bias having the opposite polarity; accordingly, the amount of "activation fog" on the photosensitive drum 1 becomes small and, as illustrated in Table 1, the amount collected can be reduced.

The degree of activeness of the triboelectric charging at the developer nip 101 is, on the condition that the toner amount in area A is larger than a certain amount, dependent on the number of rolls of the toner per unit time. The number of rolls corresponds to the value obtained by dividing the relative speed difference between the development roller 6 and the photosensitive drum 1 with the circumferential surface speed of the development roller 6 (0.17 in comparative example 1, 0.58 in example 1, and 0.67 in both examples 2 and 3). Accordingly, even when, as in example 2, the rotation speed of the development roller is decreased, an effect of decease in the "activation fog" can be obtained through a similar principle. Furthermore, with a similar effect, the effect of decrease in the "activation fog" can be obtained by, as in example 3, reducing the rotation speed of the photosensitive drum 1 and reducing the rotation speed of the development roller 6 to a rotation speed under the rotation speed during the image-forming period while maintaining a large relative speed difference. For example, it has been confirmed through the experiment that the effect of reducing the collected amount of toner in a single operation can be obtained even when, for example, as in example 3, the photosensitive drum surface speed and the development roller circumferential surface velocity are both reduced, if the peripheral speed difference between the developing roller and the photosensitive drum is larger than that during the image-forming period. Accordingly, for example, it has been confirmed through the experiment that even when the development roller circumferential surface speed in example 3 is changed to 252 mm/sec or to 300 mm/sec, the amount of toner collected per operation decreases.

As described above, by actively triboelectrically charging the toner with the developer nip 101 by increasing the relative speed difference between the photosensitive drum and the development roller during activation, the amount of charge of the toner on the development roller that has decreased while the image forming apparatus had been stopped can be increased. With the above, the "activation fog" becomes sufficiently small and an image forming apparatus adopting a mono-component contact developing method developing member includes no separation mechanism that can save energy, reduce size, and elongate life can be provided.

Second Example Embodiment

In a second example embodiment, a more desirable example embodiment in which a surface material of the photosensitive drum 1 is changed with respect to that of the first example embodiment will be described. The configurations other than the surface material of the photosensitive drum 1 are similar to those of the first example embodiment.

Example 4

In example 4, a photosensitive drum in which the surface layer is acrylic resin was used. An example of manufacturing a photosensitive drum having a surface layer formed of acrylic resin is disclosed in Japanese Patent Laid-Open No. 2016-050953. In the present example embodiment, a photosensitive drum manufactured with the exemplary manufacturing method in Japanese Patent Laid-Open No. 2016-050953 is used. Furthermore, as a control of example 4, the circumferential speed ratio of the development roller 6 against the photosensitive drum 1 during the time between time t2 and time t3 in FIG. 3 was set to 240%. The relative speed difference between the development roller 6 and the photosensitive drum 1 was 294 mm/sec.

Example 5

In example 5 as well, a photosensitive drum similar to that of example 4 was used. Furthermore, as the control of example 5, during the time between time t2 and time t3 in FIG. 3, the photosensitive drum circumferential surface speed was set to 42 mm/sec and the circumferential speed ratio of the development roller 6 against the photosensitive drum 1 was set to 300%. The relative speed difference between the development roller 6 and the photosensitive drum 1 was 84 mm/sec.

Experiment Results Verifying Effect of Disclosure

Results of an experiment for verifying the effect of the disclosure will be described. The conditions of the experiment are the same as those of the experiment in the first example embodiment. The results of the experiment are shown in Table 2.

TABLE 2

Table 2: Experiment Results Showing Effects of Disclosure in Second Example Embodiment

| | Example 4 | Example 5 |
|---|---|---|
| Surface Layer of Photosensitive Drum | Acrylic Resin | Acrylic Resin |
| Circumferential Surface Speed (mm/sec) of Photosensitive Drum | 210 | 42 |
| Circumferential Speed Ratio (%) between Developing Roller and Photosensitive Drum | 240% | 300% |
| Circumferential Surface Speed (mm/sec) of Developing Roller | 504 | 126 |
| Relative Speed Difference (mm/sec): Developing Roller − Photosensitive Drum | 294 | 84 |
| Collected Amount (mg) per Operation | 0.5 | 0.3 |
| Rotational Distance Ratio (%) between Development Roller and Comparative Example 1 in Table 1 | 200% | 50% |
| Rotational Distance Ratio (%) between Photosensitive Drum and Comparative Example 1 in Table 1 | 100% | 20% |

As illustrated in Tables 1 and 2, example 4 had an excellent effect that showed a significant decrease in the amount of toner collected per operation compared with comparative example 1, that is, the amount decreased from 4.0 to 0.5 mg. Furthermore, example 5 also had an excellent effect that showed a significant decrease in the collected amount from 4.0 to 0.3 mg. Furthermore, as illustrated in Tables 1 and 2, example 4 had an excellent effect that showed a significant decrease in the collected amount with respect to the examples 1 and 3 in which the photosensitive drums surface layer is arylate and which were conducted under the same drive condition. Furthermore, in addition to a significant effect of suppressing the "activation fog", example 5 had an excellent effect of elongating the lives of the developing unit 22 and the photosensitive member unit 21 since the rotational distances of the photosensitive drum 1 and the development roller 6 was reduced with respect to that of the comparative example 1 in Table 1.

The reason that the effects described above were obtained is as follows. The inventors found that in a mono-component contact developing method, when a photosensitive drum provided with acrylic resin on a surface layer is used, the amount of negative electric charge from the surface of the photosensitive drum increases in the developer nip 101. The above effect occurs because the electric resistance of acrylic resin is lower than that of arylate used in the first example embodiment and than that of polycarbonate that is typically used, and electric charge can be applied more readily.

Figure 5:
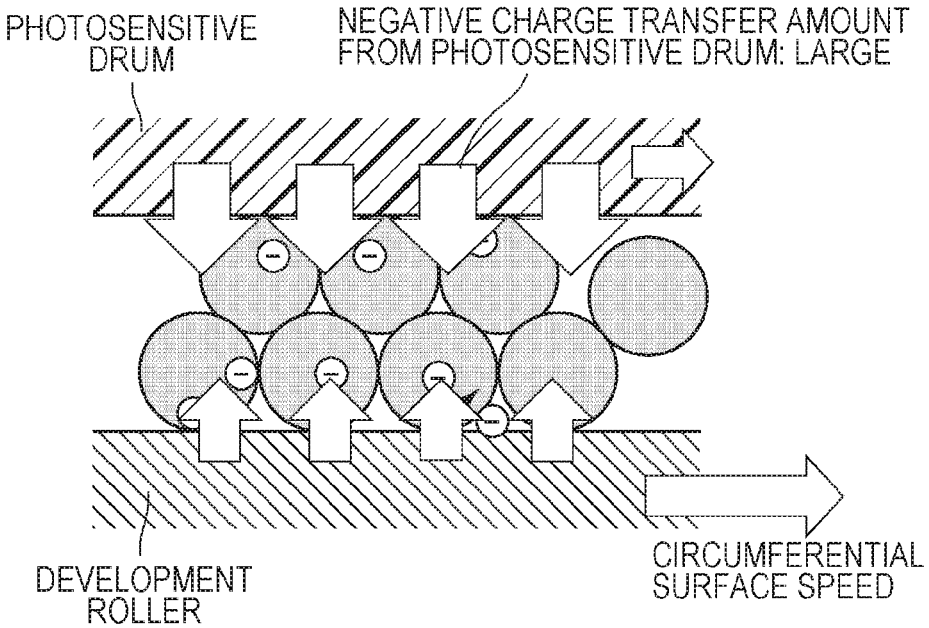
FIG. 5 is a schematic diagram illustrating a toner triboelectric charging process in a nip portion of example 4 of a second example embodiment that is a subject of the disclosure.

Examples 4 and 5 took advantage of such an effect. As illustrated in a schematic diagram of the toner triboelectric charging process in the developer nip 101 illustrated in FIG. 5, in example 4, the amount of negative electric charge from the surface of the photosensitive drum increased in the developer nip 101. Accordingly, the triboelectric charging amount per roll in the developer nip 101 was large and an effect of significantly improving the "activation fog" was obtained.

As described above, by actively triboelectrically charging the toner with the developer nip 101 by increasing the relative speed difference between the photosensitive drum and the development roller during activation, the amount of charge of the toner on the development roller that has decreased while the image forming apparatus had been stopped can be increased. With the above, the "activation fog" becomes sufficiently small and an image forming apparatus adopting a mono-component contact developing method developing member includes no separation mechanism that can save energy, reduce size, and elongate life can be provided.

Note that in the present example embodiment, as the acrylic resin of the photosensitive drum, an acrylic resin in the manufacturing example in Japanese Patent Laid-Open No. 2016-050953 was used; however, other acrylic resins can provide the same effect as that described above. For example, ultraviolet ray curable acrylic resin may provide the same effect.

Other Example Embodiments

In the above first and second example embodiments, in order to draw the charged toner to the development roller 6 at the developer nip 101, a bias having an opposite polarity has been applied to the development roller 6. However, the present disclosure is not limited to the above.

For example, in a case in which the toner carried in area A described in FIG. 6B is left alone for less than a predetermined time, the charged potential does not change much from the potential during the image-forming period. In such a case, the control device 200 may apply a bias that has the same polarity as that during the image forming operation and that is smaller in absolute value to the developing bias applying member 38 when the toner carried in area A passes through the developer nip 101 so that the toner is drawn to the development roller 6. The value of the bias applied with the developing bias applying member 38 is set so that the value is smaller than the estimated absolute value of the potential on the surface of the photosensitive drum 1. Furthermore, determination of whether the toner carried in area A has been left alone for a predetermined time or more since the image formation has been completed or whether the toner carried in area A has been left alone for less than the predetermined time can be made by having the control device 200 measure the passage of time since the completion of the image forming operation.

Furthermore, in the first and second example embodiments, as a driving member and a drive speed control member, an FOC motor is used individually in each of the development roller 6 and the photosensitive drum 1, and drive speed control is performed with high accuracy without a clutch in between. The example embodiments are not limited to the above configuration, and effects of the disclosure can be obtained as well by, as is already known, providing a first transmission mechanism that generates the drive speed during activation, and a second transmission mechanism that generates the drive speed during the image-forming period, and by switching the transmission paths thereof with an electromagnetic clutch.

The present disclosure described above can provide an image forming apparatus that is capable of reducing the generation of the "activation fog", saving more energy, reducing the size further, or elongating the life further.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-205572 filed Oct. 24, 2017, which is hereby incorporated by reference herein in its entirety.

What is claimed is:

1. An image forming apparatus comprising:

an image carrying member capable of forming an electrostatic latent image;

a developer carrying member adapted to develop the electrostatic latent image with developer;

a charge roller adapted to charge a surface of the image carrying member;

a regulating blade adapted to regulate the developer on the developer carrying member;

a speed control unit adapted to control a circumferential velocity of the developer carrying member in an independent manner with respect to a circumferential velocity of the image carrying member; and a developing bias applying member adapted to apply a bias to the developer carrying member, wherein the developer carrying member includes an area A situated from a developer nip between the image carrying member and the developer carrying member to the regulating blade disposed upstream of the developer nip in a rotation direction of the developer carrying member, wherein the developing bias applying member is adapted to create an electric potential relationship between the image carrying member and the developer carrying member so that the developer, charged to a normal polarity, is drawn to the developer carrying member (i) when the developer, carried in the area A on the developer carrying member during a stoppage of the image forming apparatus, passes the developer nip with a rotation of the developer carrying member for the first time after activation from a stopped state and (ii) before the surface of the image carrying member which is charged to a predetermined charging bias reaches the developer nip after activation from the stopped state, and wherein, after the activation from the stopped state and before an image forming operation, the speed control unit is adapted to control a circumferential speed ratio of the developer carrying member to the image carrying member to be larger than that during the image forming operation until the area A on the developer carrying member, where the developer during the stoppage of the image forming apparatus is carried, passes at least the developer nip for the first time.

2. The image forming apparatus according to claim 1 further comprising a charging bias applying member configured to apply a charging bias to the charge roller, wherein the speed control unit is adapted to control the circumferential speed ratio to be larger than that during the image forming operation at least until the surface of the image carrying member charged to the predetermined charging bias reaches the developer nip.

3. The image forming apparatus according to claim 2, wherein the speed control unit is adapted to increase the circumferential velocity of the developer carrying member so that the circumferential speed ratio is larger than that during the image forming operation.

4. The image forming apparatus according to claim 2, wherein the speed control unit is adapted to decrease the circumferential velocity of the image carrying member so that the circumferential speed ratio is larger than that during the image forming operation.

5. The image forming apparatus according to claim 1, wherein the developing bias applying member is adapted to create the electric potential relationship by applying, to the developer carrying member, a bias that has a polarity that is opposite to a normal charge polarity of the developer.

6. The image forming apparatus according to claim 1, wherein the developing bias applying member is adapted to apply a bias that has a same polarity and that has a smaller absolute value than that during the image forming operation when the developer, carried in the area A on the developer carrying member, passes through the developer nip so that the developer is drawn to the developer carrying member when a time period in which the developer carried in area A is left alone is shorter than a predetermined time period.

7. The image forming apparatus according to claim 1, wherein a surface layer of the image carrying member is acrylic resin.

8. The image forming apparatus according to claim 1, wherein the developer carrying member is in contact with the image carrying member during a stoppage of the image forming apparatus, during the image forming operation, and during a non-image-forming operation.

9. The image forming apparatus according to claim 1, wherein the developer is non-magnetic and mono-component developer.

10. A method for an image forming apparatus having an image carrying member, a developer carrying member, a charge roller, a regulating blade, a speed control unit, and a developing bias applying member, the method comprising:

forming, via the image carrying member, an electrostatic latent image;

developing, via the developer carrying member, the electrostatic latent image with developer;

charging, via the charge roller, a surface of the image carrying member;

regulating, via the regulating blade, the developer on the developer carrying member;

controlling, via the speed control unit, a circumferential velocity of the developer carrying member in an independent manner with respect to a circumferential velocity of the image carrying member; and applying, via the developing bias applying member, a bias to the developer carrying member, wherein the developer carrying member includes an area A situated from a developer nip between the image carrying member and the developer carrying member to the regulating blade disposed upstream of the developer nip in a rotation direction of the developer carrying member, wherein applying, via the developing bias applying member, includes creating an electric potential relationship between the image carrying member and the developer carrying member so that the developer, charged to a normal polarity, is drawn to the developer carrying member (i) when the developer, carried in the area A on the developer carrying member during a stoppage of the image forming apparatus, passes the developer nip with a rotation of the developer carrying member for the first time after activation from a stopped state and (ii) before the surface of the image carrying member which is charged to a predetermined charging bias reaches the developer nip after activation from the stopped state, and wherein, after the activation from the stopped state and before an image forming operation, controlling, via the speed control unit, includes controlling a circumferential speed ratio of the developer carrying member to the image carrying member to be larger than that during the image forming operation until the area A on the developer carrying member, where the developer during the stoppage of the image forming apparatus is carried, passes at least the developer nip for the first time.

11. The method according to claim 10, further comprising applying a charging bias to the charge roller, wherein the speed control unit is adapted to control the circumferential speed ratio to be larger than that during the image forming operation at least until the surface of the image carrying member charged to the predetermined charging bias reaches the developer nip.

12. The method according to claim 11, wherein the speed control unit is adapted to increase the circumferential velocity of the developer carrying member so that the circumferential speed ratio is larger than that during the image forming operation.

13. The method according to claim 11, wherein the speed control unit is adapted to decrease the circumferential velocity of the image carrying member so that the circumferential speed ratio is larger than that during the image forming operation.

14. The method according to claim 10, wherein the developing bias applying member is adapted to create the electric potential relationship by applying, to the developer carrying member, a bias that has a polarity that is opposite to a normal charge polarity of the developer.

15. The method according to claim 10, wherein the developing bias applying member is adapted to apply a bias that has a same polarity and that has a smaller absolute value than that during the image forming operation when the developer, carried in the area A on the developer carrying member, passes through the developer nip so that the developer is drawn to the developer carrying member when a time period in which the developer carried in area A is left alone is shorter than a predetermined time period.

16. The method according to claim 10, wherein a surface layer of the image carrying member is acrylic resin.

17. The method according to claim 10, wherein the developer carrying member is in contact with the image carrying member during a stoppage of the image forming apparatus, during the image forming operation, and during a non-image-forming operation.

18. The method according to claim 10, wherein the developer is non-magnetic and mono-component developer.

* * * * *